United States Patent [19]

Niemeijer

[11] Patent Number: 4,614,373

[45] Date of Patent: Sep. 30, 1986

[54] LOCKING SEAL AND SEAL ELEMENT THEREFOR

[75] Inventor: Halbe J. Niemeijer, Bruntinge, Netherlands

[73] Assignee: Tatoprint Nederland B.V., Netherlands

[21] Appl. No.: 567,759

[22] Filed: Jan. 3, 1984

[51] Int. Cl.[4] ..... B05D 33/34

[52] U.S. Cl. ..... 292/318

[58] Field of Search ..... 292/307 A, 316, 318, 292/319, 320, 321, 322; 24/16 PB

[56] References Cited

U.S. PATENT DOCUMENTS

| | | | |
|---|---|---|---|
| 831,825 | 9/1906 | Brooks | 292/318 |
| 930,227 | 8/1909 | Reister | 292/319 |
| 961,069 | 6/1910 | Crudginton | 292/319 |
| 1,423,881 | 7/1922 | Rogers | 292/322 |

FOREIGN PATENT DOCUMENTS 2435197 4/1980 France .

*Primary Examiner*—Richard E. Moore

*Attorney, Agent, or Firm*—Andrus, Sceales, Starke & Sawall

[57] ABSTRACT

A locking seal for sealing objects comprises a seal element (1) and a fixing pin (3) having a punctiform end part (4) and a counterelement (8). The seal element (1) comprises a main plate (9) and a closing plate (10), the rims (14,15,16,17) of said plates being connected with one another. The main plate is, at least in a fastening part; completely closed and together with the closing plate it bounds a space (13), in which a clamping means is located. When the locking seal is closed, the fixing pin is passed by the end part (4) through an orifice in the closing plate and clamped tight by the clamping means with respect to the seal element.

6 Claims, 3 Drawing Figures

LOCKING SEAL AND SEAL ELEMENT THEREFOR

The invention relates to a locking seal for sealing objects, comprising a seal element, a fixing pin having at one end a punctiform end part and a counter-element connected with the other end of the fixing pin, said fixing pin being passed by the end part through the object to be sealed prior to the application of the locking seal and subsequently being clamped tight by the punctiform end part with respect to the seal element in a manner such that after closure of the locking seal the object is located between the seal element and the counter-element.

Locking seals of the kind set forth have a structure such that the seal element can be readily loosened from the fixing pin without resulting in visible damage of the locking seal. Therefore, the locking seals hitherto used do not guarantee the prevention of reuse of a locking seal on another object. Hence the known locking seals do not offer, in practice, adequate safeguard against abuse.

The invention has for its object to provide a particularly reliable, yet cheap locking seal, which cannot be dismounted without visible damage.

According to the invention this is achieved by a seal element comprising a main plate and a closing plate, the lateral rims of said plates being connected with one another, said main plate having a completely closed fastening part and said closing plate having an orifice for passing the punctiform end part of the pin, whilst near said orifice in the space between the main plate and the closing plate is located a clamping means by which the pin is clamped tight with respect to the seal element when the locking seal is applied.

In this way a locking seal is obtained that can be readily applied, whilst the main plate of the seal element, which may be provided with marks, cannot be disengaged from the edges of the closing plate without visible damage. Therefore, any disengagement of a locking seal once closed can be immediately recognized so that tampering with the locking seal embodying the invention can very effectively be prevented. Particularly, the locking seal embodying the invention can be used on those objects, which are requiring a satisfactory check and/or identification on the object itself, for example sealing a container or marking an animal.

A preferred embodiment of a locking seal in accordance with the invention is characterized in that the clamping means is formed by a spring steel clamping plate and the fixing pin has, near the punctiform end part, a groove intended to receive the clamping rims of the clamping plate. Thus when the locking seal is closed, the pin is rapidly and effectively clamped tight and afterwards, owing to the effect of the clamping rims, it is not possible to draw off the punctiform end part of the pin without rupture.

A further preferred embodiment of a locking seal in accordance with the invention is characterized in that the fixing pin has a locally weakened part in a main part adjoining the groove. Any attempt of drawing off the locking seal by force will thus result in rupture of the fixing pin in the weakened part, whilst the fraction with the groove remains clamped in the clamping plate and thus blocks the passage in the closing plate. This blocking prevents a new fixing pin from being inserted.

The counter-element is preferably formed by an end part of a first limb of a spring steel bracket, the fixing pin being clamped in said end part, said bracket having a second limb, which is resiliently pivotable with respect to the first limb and on which second limb the seal element is arranged in a manner such that the limb tends to pivot the seal element away from the fixing pin. This construction has the advantage that even prior to application of the seal the component parts of the locking seal constitute a composite unit, which can easily be stored and handled. The resiliently pivotable disposition of the two limbs has the advantage that in applying the locking seal the punctiform end part of the pin is invariably located at a distance from the seal element.

When the clamping plate is formed by a bent-over part of the second limb, which has an orifice for passing the punctiform end part of the pin, no additional parts are required for the clamping plate. Moreover, the clamping plate can then be satisfactorily positioned in the space between the main plate and the closing plate.

A still further preferred embodiment of a locking seal in accordance with the invention is characterized in that at the end remote from the fastening part the main plate has an end part obliquely bent-over with respect to the adjacent part and having a slot-like opening, through which the second limb is slid. In this manner the seal element can be simply slipped onto the second limb of the bracket, whilst by closing the locking seal the seal element is guarded against sliding back on the limb.

A seal element suitable for use in a locking seal embodying the invention is characterized in that the main plate and the closing plate are made from a single piece of material and the closing plate is bent over about 180° with respect to the main plate. Thus the seal element constitutes a unit, which may be kept separated from the further parts of the locking seal and can be readily mounted.

A preferred structure of the seal element embodying the invention, in which the punctiform end part of the pin can be satisfactorily locked in the space between the main plate and the closing plate, is characterized in that the fastening part of the main plate has a conical shaped embossed part. If in this structure the pin breaks down, the remaining part remains satisfactorily positioned in the conical embossed part, since this part completely blocks the passage.

By a further preferred structure of a seal element embodying the invention, which is characterized in that lateral rims of the main plate are bent over around the lateral rims of the closing plate and the main plate has recesses near the lateral rims, it is ensured that the deflection of the lateral rims of the main plate can be accurately carried out. If attempts were made to grind off the bent-over side rims in order to dismount the locking seal, this operation would be immediately detectable owing to the presence of the recesses.

The invention will be described more fully with reference to an embodiment illustrated in the drawing, to which the invention is, however, not limited.

Figure 1:
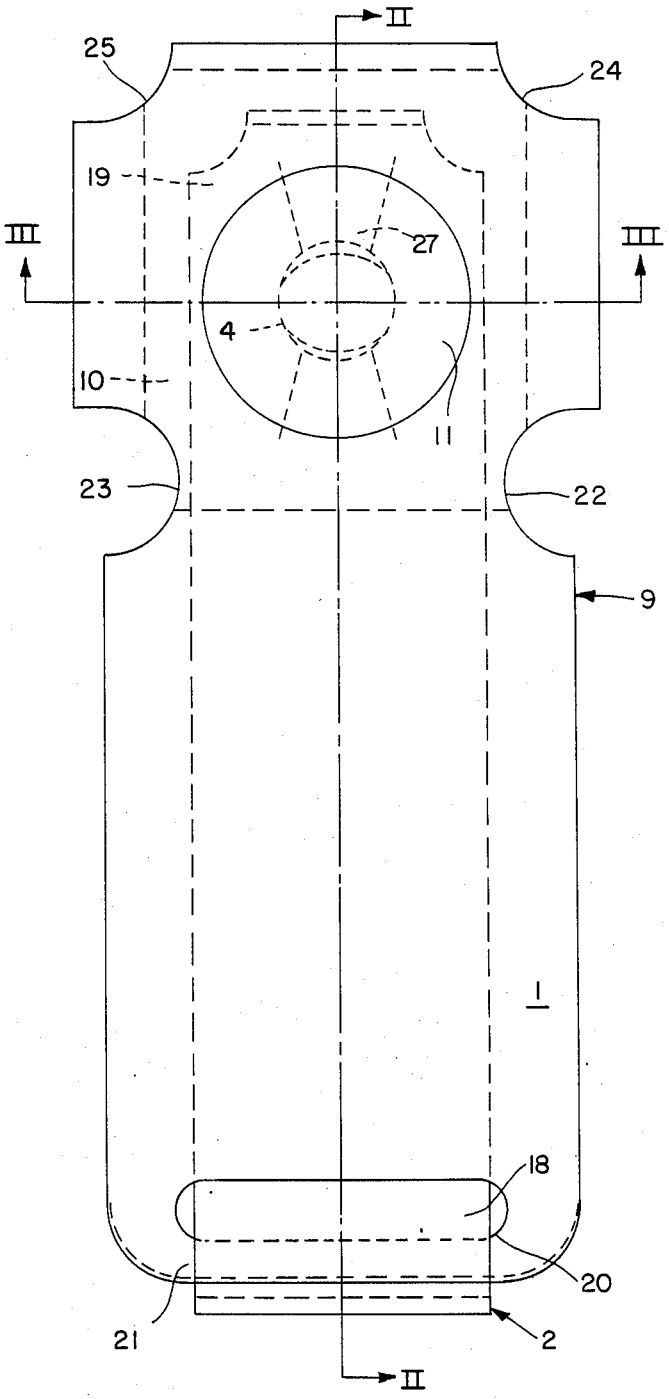
FIG. 1 is an elevational view of a locking seal embodying the invention in a closed position.
Figure 2:
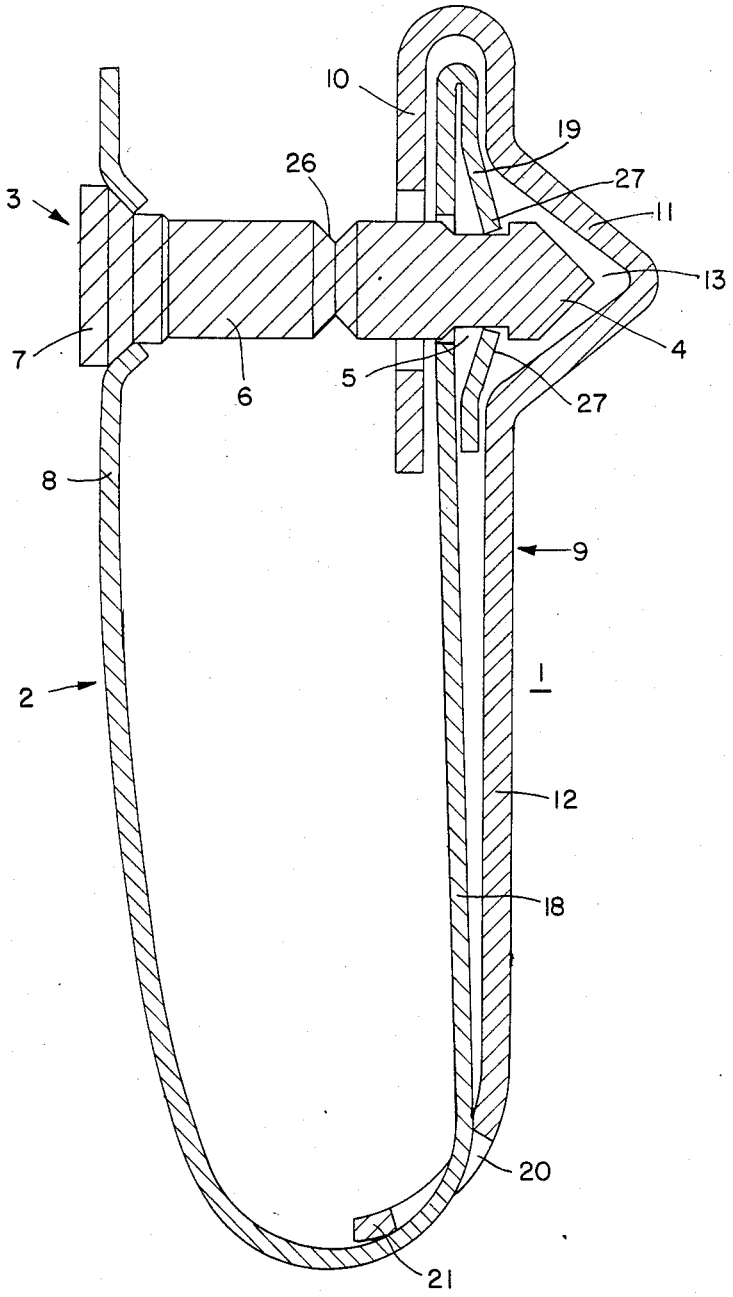
FIG. 2 is a sectional view taken on the line II—II in FIG. 1.

The locking seal shown in FIGS. 1 and 2 comprises a seal element 1, a spring steel bracket 2 and a fixing pin 3. The galvanized steel fixing pin 3 has at one end a punctiform, preferably conical end part 4. Near the end part 4 the pin 3 has a continuous groove 5 adjoining a cylindrical main part 6 of the pin. The main part 6 has a locally weakened part 26, where rupture occurs when a force is exerted on the pin in an attempt to open the locking seal. Preferably the part 26 is located about midway along the length of the pin 3. At the end remote from the end part 4 the pin 3 has a shoulder 7, which is in contact with a first limb 8 of the bracket 2, in which limb the pin 3 is clamped and which limb constitutes a counter-element of the locking seal. It should be noted that, as an alternative, the pin 3 may be connected by welding with the limb 8.

The seal element 1 comprises a main plate 9 and a closing plate 10, which plates are made from a single sheet of material, in this embodiment aluminium, by bending over through about 180°. It is emphasized that the element may be manufactured in a different way, for example from a synthetic resin. The main plate 9 has a fastening part 11 and an elongate main part 12, on which marks may be made for identifying and/or checking purposes. The fastening part is completely closed and has a conical embossed part by which the fastening part bounds a space 13 on one side for accommadating the end part 4 of the pin 3. Preferably the conical shape of the protuberance matches the shape of the end part 3 so that a close fit of the end part 4 can be obtained.

Figure 3:
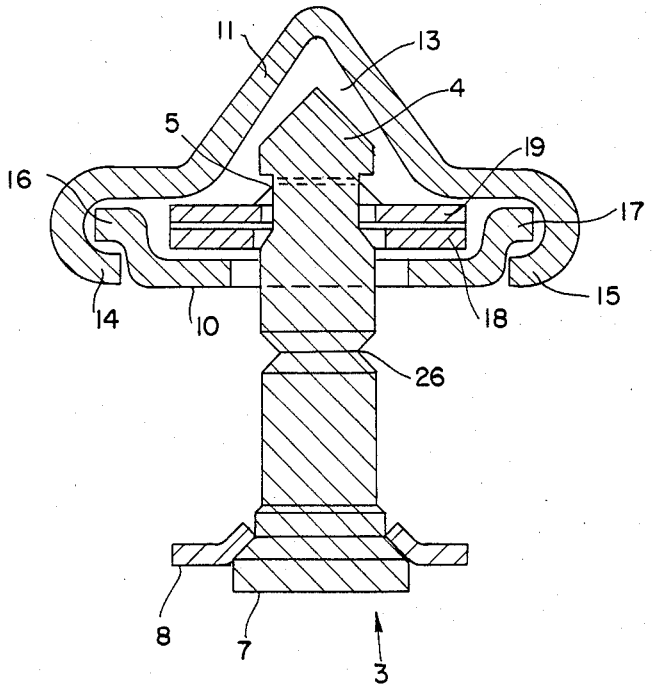
FIG. 3 is a sectional view taken on the lines III—III in FIG. 1.

As is shown in FIG. 3, lateral rims 14 and 15 of the main plate are bent around lateral rims 16 an 17 of the closing plate 10, the rims 16 and 17 being bent over with respect to the main surface of the closing plate in a manner such that the main surface is spaced apart from the part 11 of the main plate. Thus the space 13 is sufficiently large for receiving a second limb 18 of the bracket 2 together with a clamping plate 19. In a central part the clamping plate 19 has resilient clamping edges 27 forming together a clamping means for the pin 3. The clamping plate is formed from the second limb 18 by being bent over through about 180°. The clamping plate is preferably located on the outer side of the limb 18.

The seal element 1 is arranged on the second limb 18 by sliding the limb through a slot-like opening 20 in an obliqely bent-over end part 21 of the main plate 9. By subsequently sliding the limb 18 into the space 13, the clamping plate 19 also enters the space. Then the resiliently pivotable limbs 8 and 18 ensure that the pin 3 with the end part 4 is kept spaced apart from the closing plate 10.

For applying the locking seal embodying the invention the pin 3 is pressed by means of a propriate pincers across the relevant part of the object, for example, across the ends of a closing rim around a box-shaped object to be sealed, after which the end part 4 is urged through a passage in the closing plate 10 into the space 13. The part of the object is then located between the limb 18 and the closing plate 10. In the space 13 the end part 4 can move through a passage in the limb 18 of the bracket 2. Subsequently, when passing by the clamping plate 19, the clamping rims 27 bent over in the direction towards the fastening part 11 and get into the groove 5 so that withdrawal of the pin 3 becomes impossible without causing visible damage to the locking seal.

The bent-over rims 14 and 15 of the main plate 9 cannot be loosened, for example by grinding, from the closing plate 10 without visible deformations. Owing to the nature of the material of the seal element even bending back the rims can be immediately detected. The recesses 22,23,24 and 25 in the main plate 9 near the rims 14 and 15 and in the closing plate 10 near the rims 16 and 17 contribute not only to an accurate locating of the rims but also to an easier detectability of said deformations of the rims 14 and 15.

By the specific method of clamping the punctiform end part 4 in the closed space 13, when the locking seal is closed, it is ensured that a locking seal once closed cannot be made reusable. Therefore, the locking seal embodying the invention offers a reliable possibility of identifying and/or checking objects and a safeguarding the objects against fraudulent handling. In general the locking seal embodying the invention can be used on objects which are marked by means of a sealing stamp or a lead seal. More particularly the locking seal can be used on objects requiring a satisfactory check and/or identification of the object itself, for example, when used as an earmark on an animal or of the contents of the object, for example, for sealing a mail bag or a container.

The invention also relates to variants of the locking seal shown.

What we claim is:

1. A locking seal for sealing objects comprising:

a bracket (2) having a first limb (8) and a second limb (18) positionable in a generally parallel, spaced relationship;

a fixing pin (3) having at one end a punctiform end part (4) and having the other end (7) affixed on the end of said first limb (8) to orient the pin generally perpendicular to said spaced limbs, said fixing pin being insertable through a portion of the object to be sealed so that the portion lies between said limbs;

a clamping means (19, 27) integrally formed in the end of said second limb (18) for receiving and retaining said fixing pin proximate said punctiform end part (4), said clamping means being formed by folding over the end of said second limb to form a portion on the opposite side from said first limb, said second limb having a hole through which said fixing pin passes, said folded over end portion including means for retaining said fixing pin; and a seal element (1) comprising a main plate (9) and a contiguous parallel lying closing plate (10) formed of a single piece of bent material, said seal element embracing said clamping means on either side thereof, the side edges of said seal element being joined to one another, said closing plate (10) having an orifice through which said fixing pin (3) passes when received in said clamping means, said main plate covering the punctiform end of said fixing pin when same is received in said clamping means.

2. A locking seal as claimed in claim 1 wherein said main plate of said seal element includes means for retaining said seal element on said bracket.

3. A locking seal as claimed in claim 1 wherein the side edges of said main plate are bent around the side edges of said closing plate.

4. A locking seal as claimed in claim 1 wherein said main plate has a conically shaped embossed part for accommodating said punctiform end part (4) of said fixing pin.

5. A locking seal as claimed in claim 1 wherein said fixing pin has, proximate said punctiform end part, a groove and wherein said clamping means has a plurality of resilient clamping edges in said folded over end portion, said clamping edges being deflectable upon the insertion of said fixing pin in said clamping means and engaging in said groove for retaining said fixing pin in said clamping means.

6. A locking seal as claimed in claim 1 wherein said fixing pin has a weakened portion (26) in the portion between said limbs.

* * * * *